US005871657A

United States Patent [19]

Nelson

[11] Patent Number: 5,871,657

[45] Date of Patent: Feb. 16, 1999

[54] INK JET PRINTHEAD WITH IMPROVED ADHESIVE BONDING BETWEEN CHANNEL AND HEATER SUBSTRATES

[75] Inventor: Richard D. Nelson, Pittsford, N.Y.

[73] Assignee: Xerox Corporation, Stamford, Conn.

[21] Appl. No.: 4,255

[22] Filed: Jan. 8, 1998

[51] Int. Cl.[6] ..... B11B 5/27

[52] U.S. Cl. ..... 216/27; 216/33; 216/34

[58] Field of Search ..... 216/27, 34, 33

[56] References Cited

U.S. PATENT DOCUMENTS

| | | | |
|---|---|---|---|
| Re. 32,572 | 1/1988 | Hawkins et al. | 156/626 |
| 4,678,529 | 7/1987 | Drake et al. | 156/234 |
| 4,774,530 | 9/1988 | Hawkins | 346/140 R |
| 5,368,683 | 11/1994 | Altavela et al. | 156/633 |

*Primary Examiner*—Bruce Breneman
*Assistant Examiner*—Shamim Ahmed

[57] ABSTRACT

An improved process is provided for aligning and bonding channel and heater substrates together to form a thermal ink jet printhead. A thick film polyimide layer is formed over the heater substrate and is patterned to provide a plurality of tacking pits. The channel substrate has alignment holes formed in peripheral edge areas. A UV curable adhesive is deposited into the alignment hole and UV irradiated to produce a cured tacking column in the underlying pits formed in the thick film layer. Due to the sloping walls of the etched alignment recess, some portion of the adhesive is not fully cured and, during a subsequent curing process, tends to initiate a capillary flow along the interface between channel substrate and the thin film layer. This flow, in prior art designs, sometimes proceeds to the point where the adhesive is squeezed out onto electrode connections formed on an adjacent heater substrate. The formation of the pits serves to interrupt and trap the flow of the uncured adhesive, thus, preventing further flow and eliminating subsequent contamination.

1 Claim, 3 Drawing Sheets

INK JET PRINTHEAD WITH IMPROVED ADHESIVE BONDING BETWEEN CHANNEL AND HEATER SUBSTRATES

BACKGROUND OF THE INVENTION AND MATERIAL DISCLOSURE STATEMENT

This invention relates to the ink jet printing technology, and more particularly to an improved method of fabricating a plurality of thermal ink jet printheads from two aligned and bonded substrates which are fastened together by a thermosetting adhesive and a UV curable adhesive inserted into alignment openings formed in portions of the substrates to hold the substrates together until the thermosetting adhesive is cured.

One preferred method of fabricating thermal ink jet printheads is to form the heating elements on the surfaces of one silicon wafer and the channels and small ink supply chamber of reservoir in the surface of another silicon wafer. The two wafers are precisely aligned to insure that the heating elements are aligned to their corresponding channels, and then the two wafers are bonded together. The individual printheads are obtained by dicing the two bonded wafers. This general process has been described in Re. U.S. Pat. No. 32,572 to Hawkins et al. A critical part of this assembly process is the bonding adhesive and its application. Since two silicon wafers are mated that are extremely flat, a thin adhesive coating is sufficient to bond the two together, and a much thicker coat will clog the channels. U.S. Pat. No. 4,678,529 to Drake et al., describes a method of bonding the ink jet printhead components together by coating a flexible substrate with a relatively thin uniform layer of an adhesive having an intermediate non-tacky curing stage. About half of the adhesive layer is transferred from the flexible substrate to the high points or lands of one of the printhead components by placing it in contact therewith, and applying a predetermined temperature and pressure to the flexible substrate prior to peeling it from the printhead component. This causes the adhesive to fail cohesively in the liquid state, assuring that about half of the thickness of the adhesive layer stays with the flexible substrate and is discarded therewith, leaving a very thin uniform layer of adhesive on the printhead component lands. The transferred adhesive layer remaining on the printhead component enters an intermediate non-tacky curing stage to assist in subsequent alignment of the printhead components. The printhead components are aligned and the adhesive layer cured to complete the fabrication of the printhead.

U.S. Pat. No. 4,774,530 to Hawkins discloses an improved ink jet printhead which comprises an upper and lower substrate that are mated and bonded together with a thick film insulative layer sandwiched therebetween. The thick film layer is deposited on the substrate containing the heating elements and addressing electrodes and recesses are patterned in the thick film layer to expose the heating elements to the ink, thus placing them in a pit and to provide a flow path for the ink from the reservoir to the channels by enabling the ink to flow around the closed ends of the channels, thereby eliminating the fabrication steps required to open the channel grooves to the reservoir recess.

FIG. 1 shows a cross-sectional view of an upper channel substrate 2, lower heater substrate 4, and insulative layer 6 of a prior art embodiment equivalent to the '530 patents, whose contents are hereby incorporated by reference. Substrates are shown following an alignment and bonding step. As is disclosed in the '530 patent, several tacking portions 8 are selected around the periphery of the joint substrates, area 8 to be discarded after completion of the tacking step leaving printhead 10 permanently bonded thereto by curing the adhesive applied to the surface of layer 6.

The bonding process includes an initial step of tacking together the substrates. This is accomplished by first forming alignment pits 12 in each predetermined tacking portion 8. The location of these pits is selected so as not to interfere with the functional portion of the printhead 10; e.g., to the right of portion 8. A further etching process creates a plurality of adjacent openings 14 in channel substrate 2. Openings 14 are formed so that they overlie pits 12 when the substrates are aligned. Thus, each portion 8 has a single alignment opening 14 overlying a single pit 12 formed in the insulation layer.

At this point, a thermal setting adhesive 15 is applied to the surface of layer 6, and the substrates are held together in an alignment fixture. This alignment insures that the heating elements formed in the heater substrate underlie channels formed in the channel substrate. Tacking occurs by introducing a UV curable adhesive 20 such as, for example, Loctite 375™. Adhesive 20 is inserted into alignment openings 14 and then downward into pits 12 and irradiated by light from UV source 22. Due to the sloping sides of opening 14 caused by the forming etch process, side portions 20A, 20B of the adhesive are not fully irradiated by the UV light. Thus, adhesive 20 consists of two segments, a cured portion 20C and uncured portions 20A, 20B. When the adhesive is fully cured, the cured adhesive column 20C acts as a tacking "anchor" and improves the sheer strength of the fastened points of the mated wafers. With the cured UV curable adhesive (or cured cyanoacylate) preventing slippage or misalignment between the mated substrates, the substrates are removed from the alignment fixture or IR aligner and moved to a curing oven or vacuum laminator (not shown) and the thermosetting adhesive 15 cured at elevated temperatures. As shown, the unexposed, uncured adhesive segments 20A, 20B initiate a capillary flow radially outward as indicated by arrows 24. The adhesive flow can ultimately be squeezed out the sides of portion 8 and contact bond pads 26 which are formed on the surface of heater substrate 4 causing faulty interconnection to heater energization signals.

SUMMARY OF THE INVENTION

It would be desirable to improve the curing of the tacking adhesive to remove the non-cured adhesive component.

It would also be desirable to prevent the non-cured adhesive from migrating along the bonded surfaces of the heater/insulating layer/channel substrates thereby preventing contamination of electrodes formed on the heater substrate surface.

According to the invention, the insulating layer formed between the channel and heater substrate is patterned with a plurality of pits, which radiate outward from the alignment hole. Any non-cured adhesive that has a tendency to flow by capillary action along the bonded interface will now fall into these pits and will not reach the bond pad electrode surfaces on the heater substrate.

More particularly, the invention is directed towards a method for aligning and tacking together a channel and heater substrate of an ink jet printer, comprising the steps of:

- applying a thermosetting adhesive to the bottom surface of a channel substrate,
- depositing a photopatternable thick film polymer layer on the surface of a heater substrate,
- identifying peripheral areas of said polymeric layer where tacking will be accomplished, etching said polymeric layer to form a plurality of pits in each of said identified peripheral areas, mating the channel substrate to the heater substrate with the thick film layer sandwiched therebetween, etching an alignment hole in the channel substrate in each of said identified peripheral tack areas, introducing a UV curable adhesive into said alignment hole, said adhesive filling a plurality of pits in said insulating layer which underlies said alignment hole, irradiating said tacking adhesive with a UV light source, curing most of the introduced adhesive but leaving uncured segments, curing the tacked substrates until the thermosetting adhesive is fully cured whereby said previously uncured segments migrate in a capillary flow along the interface formed at the channel substrate and are deposited into said plurality of pits and separating the tacking portion from the fully bonded substrates.

DESCRIPTION OF THE INVENTION

Figure 1:
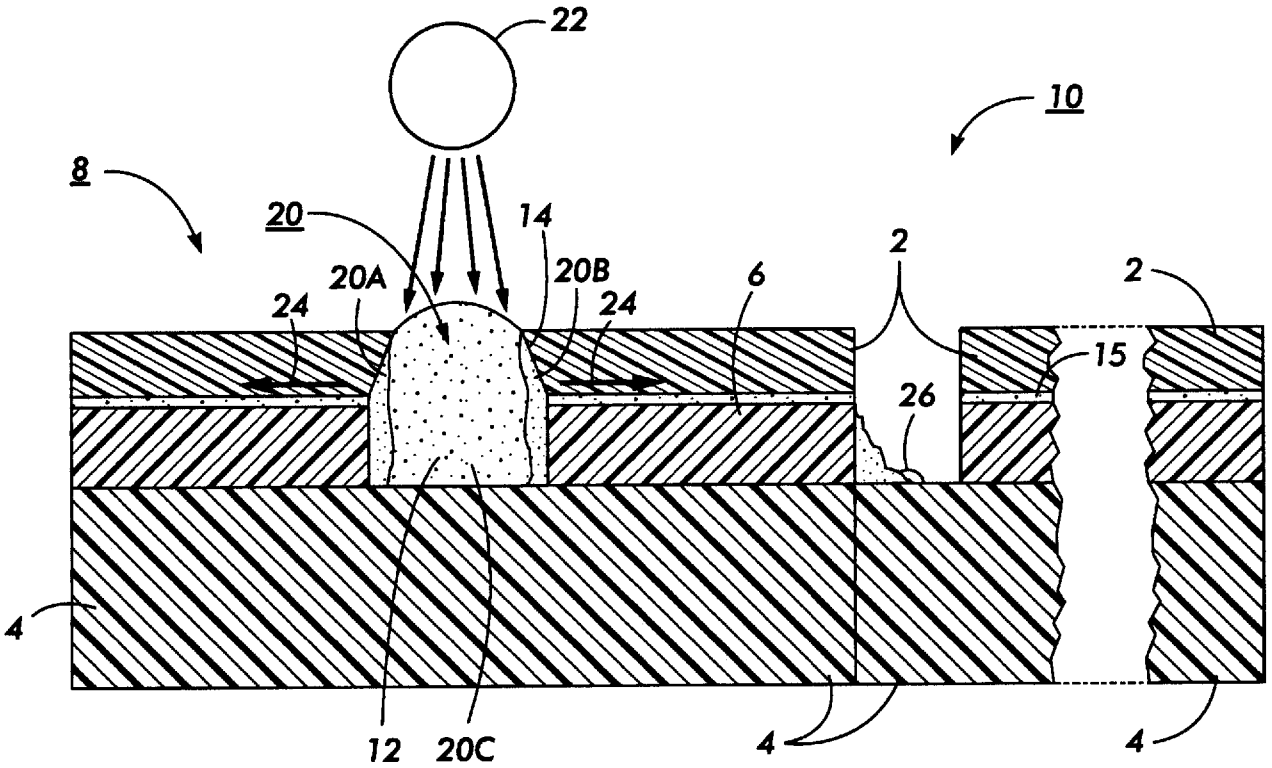
FIG. 1 PRIOR ART
FIG. 1 a partial cross-sectional view of a prior art printhead with substrates aligned and tacked together.
Figure 2:
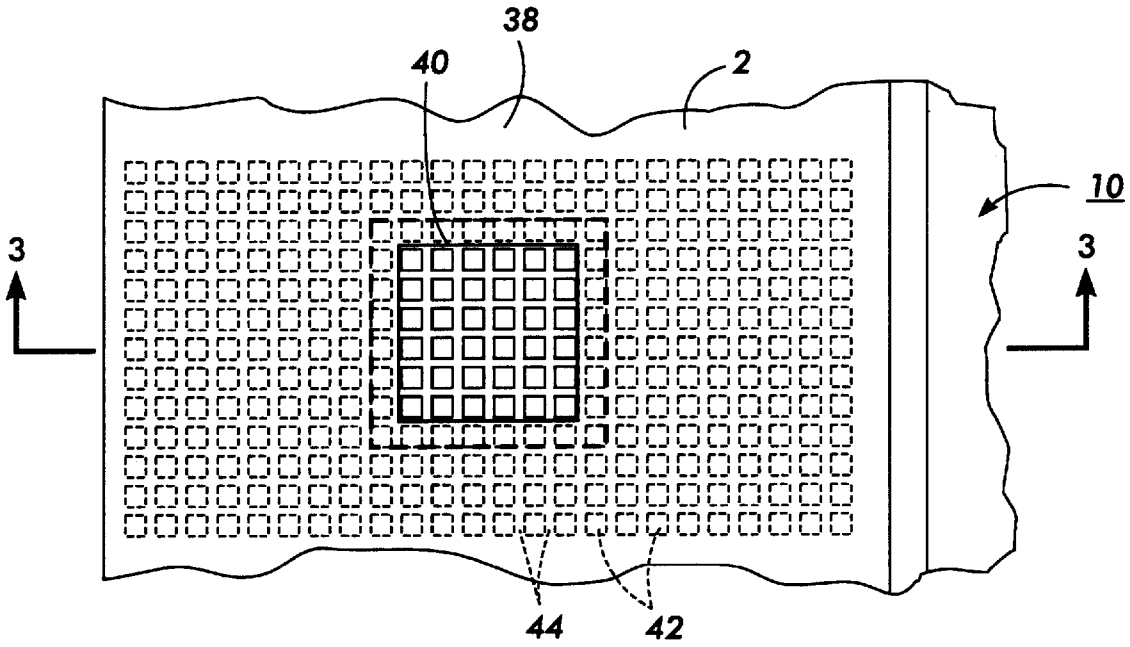
FIG. 2 is a top view of an alignment and tacking portion of a printhead wafer constructed according to the invention.
Figure 3:
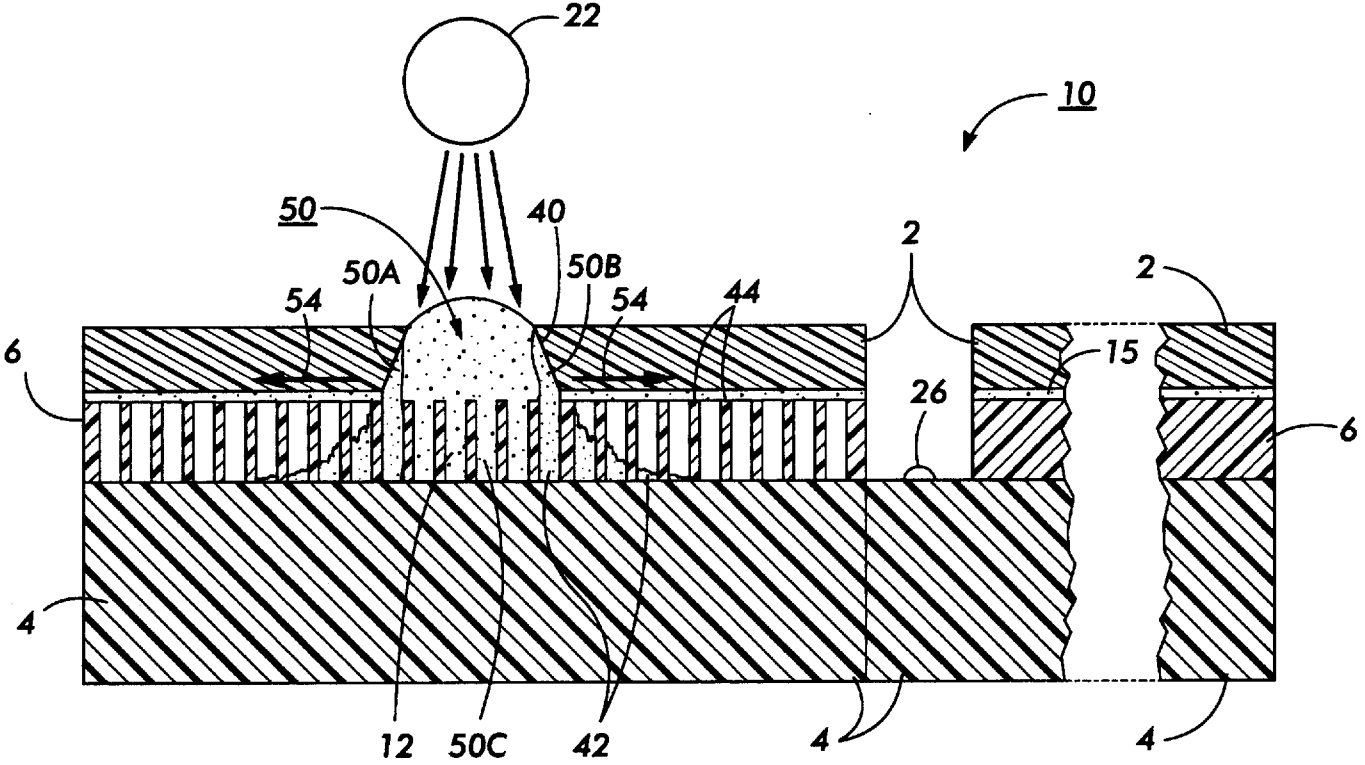
FIG. 3 is a view through section 3—3 of FIG. 2.

As disclosed in Re. U.S. Pat. No. 32,572 to Hawkins, U.S. Pat. No. 4,678,529 to Drake et al., and U.S. Pat. No. 4,774,530 to Hawkins, all of which are incorporated herein by reference, a plurality of prior art individual printheads 10, as shown in FIGS. 1, 2 and 3, are fabricated by forming a plurality of arrays of heating elements and a driver circuitry for each array with addressing electrodes 26 and a common return on a surface of a heater substrate 4. Thick-film, polymeric layer 6 is deposited on layer 2 and is patterned to remove the thick-film layer directly over the heating elements and electrodes 26 and to provide a bypass pit, one for each channel recess. The exposed heating elements are thus recessed in the pits and the terminals are exposed for subsequent wire bonding to a source of electrical signals from printer controller. Channel substrate 2 has on one surface thereof a plurality of sets of etched channel recesses or grooves with an etched reservoir recess for each set of channel recesses, and the substrate surface with the recesses is coated with a thermosetting adhesive 15. The two substrates are to be aligned and mated so that the channel substrate surface with the recesses and adhesive coating is in contact with the layer 6 formed on the surface of substrate 2 containing the heating elements and associated circuitry. An improved tacking process is provided according to the invention and as shown in FIGS. 2, 3 by modifying the tacking portion 8 of the prior art to form an improved tacking portion 38. Portion 38 retains a portion of the channel substrate 2 having alignment tacking holes 40 etched therethrough. The insulating layer 6 of the prior art has been modified by patterning layer 6 to provide a plurality of pits 42 separated by segments 44. The substrates 2 and 4 are aligned as previously described, except there is no longer a need for matching the alignment opening in the channel substrate 2 with a single alignment pit in layer 6. With substrates 2 and 4 held in alignment by an alignment fixture, UV adhesive 50 is inserted into alignment openings filling pits 42 directly beneath hole 40. UV light source 22 is energized irradiating the adhesive 50 and forming a cured segment 50C and uncured segments 50A, 50B.

When the adhesive is fully cured, segment 50C acts as an "anchor", or rather a plurality of anchors, each formed in one of the underlying pits 42. The substrates are then removed from the alignment fixture and moved to a curing oven where thermosetting adhesive 15 is cured at elevated temperatures. As in the description of the prior art, the uncured adhesive segments 50A, 50B initiate a capillary flow radially outward from the center of the alignment opening as indicated by arrows 54. The adhesive flow now encounters a plurality of pits 42 with a portion of adhesive flowing into the pits leaving adhesive deposits which decrease in depth out to the perimeter of the portion 38. However, due to the construction, no adhesive will reach the ends of portion 38 adjacent the printheads, so no adhesive will be squeezed out to possibly contaminant electrodes 26.

As a further benefit of this construction, a more secured tacking is enabled because each of the pits acts as an additional "anchor" to maintain an accurate alignment during the final curing step.

While the embodiment disclosed herein is preferred, it will be appreciated from this teaching that various alternative, modifications, variations or improvements therein may be made by those skilled in the art, which are intended to be encompassed by the following claims:

I claim:

1. A method for aligning and tacking together a channel and heater substrate of an ink jet printer, comprising the steps of:

applying a thermosetting adhesive to the bottom surface of a channel substrate, depositing a photopatternable thick film polymer layer on the surface of a heater substrate, identifying peripheral areas of said polymer layer where tacking will be accomplished, etching said polymer layer to form a plurality of pits along a length of said identified peripheral areas, mating the channel substrate to the heater substrate with the thick film layer sandwiched therebetween, etching an alignment hole in the channel substrate in a portion of each of said identified peripheral tack areas, introducing a UV curable adhesive into said alignment hole, said adhesive filling only those pits which directly underlie said alignment hole leaving a plurality of pits not filled by said adhesive during said adhesive introduction step, irradiating said tacking adhesive with a UV light source, curing most of the introduced adhesive but leaving uncured segments, curing the tacked substrates until the thermosetting adhesive is fully cured whereby said previously uncured segments migrate in a capillary flow along the interface formed at the channel substrate and are deposited into at least some of said plurality of pits not filled during said adhesive introduction step and separating the tacking portion from the fully bonded substrates.

* * * * *